United States Patent [19]

Totten

[11] Patent Number: 4,936,359

[45] Date of Patent: Jun. 26, 1990

[54] METHOD AND APPARATUS FOR BREAKING CORNERS OF WOOD MEMBERS

[75] Inventor: Clyde Totten, Castaic, Calif.

[73] Assignee: CCX Fantastic, Inc., Castaic, Calif.

[21] Appl. No.: 216,415

[22] Filed: Jul. 7, 1988

[51] Int. Cl.[5] ..... B27M 1/02

[52] U.S. Cl. ..... 144/2 R; 144/362

[58] Field of Search ..... 427/325, 358, 297; 256/19, 59; 144/2 R, 4, 49, 137, 359, 360, 361, 362; 100/153, 171, 176

[56] References Cited

U.S. PATENT DOCUMENTS

| | | | |
|---|---|---|---|
| 2,780,253 | 2/1957 | Joa | 144/246 G |
| 2,794,466 | 6/1957 | Leffler | 144/246 F |
| 3,024,819 | 3/1962 | Dosker | 144/359 |

FOREIGN PATENT DOCUMENTS

| | | | |
|---|---|---|---|
| 421506 | 12/1974 | U.S.S.R. | 144/361 |

*Primary Examiner*—W. Donald Bray

*Attorney, Agent, or Firm*—Blakely, Sokoloff, Taylor & Zafman

[57] ABSTRACT

A method and apparatus for breaking corners of wood members prior to the plastic coating of the same is disclosed. In accordance with the method, the wood members such as fence rails and posts are forced between a system comprising four spring mounted rollers, each of which forcibly engages one corner of the wood member and crushes the same in the desired profile. The rollers may be shaped to provide a radius type profile or other desired profile, or alternatively, may be substantially flat to break the 90 degree corner into two more gentle 45 degree corners. In general, the amount of the crushing is controlled by the spring pressure forcing the rollers into the corners, and is relatively self controlling because of the increase in the width of the crushed area as the amount of crushing increases. Such crushing removes the sharp corner on the rails and posts so that upon the subsequent plastic extrusion coating process, the tendency of the plastic coating to contract laterally will not cause the plastic coating to unnecessarily thin at the corners of the wood members, or to be cut thereby.

5 Claims, 2 Drawing Sheets

FIG. 4
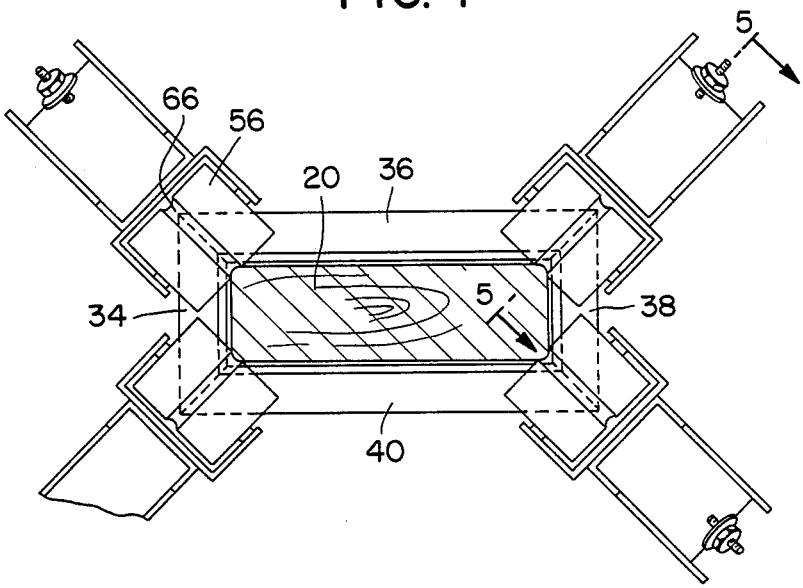
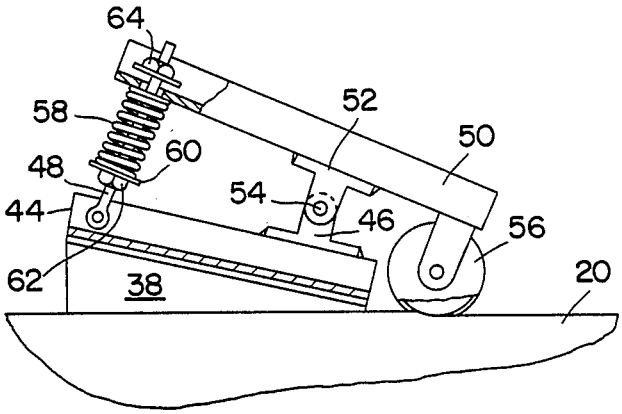
FIG. 5
FIG. 6
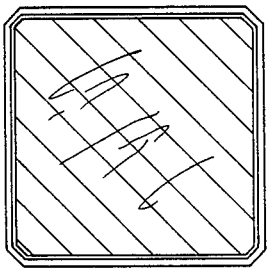
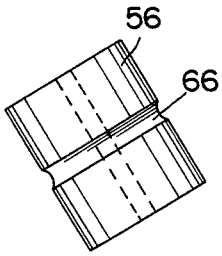
FIG. 7
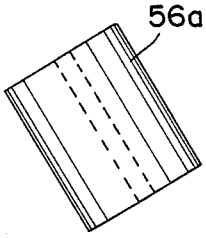
FIG. 8
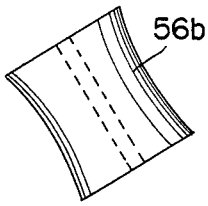
FIG. 9

METHOD AND APPARATUS FOR BREAKING CORNERS OF WOOD MEMBERS

BACKGROUND OF THE INVENTION

1. Field of the Invention

The present invention relates to the field of plastic coating of wood.

2. Prior Art

U.S. Pat. No. 4,181,764 describes a process for the plastic coating of wood members such as fence rails and posts which results in a very attractive, relatively maintenance free and long-life decorative fencing. In accordance with the process, the wood members are introduced along their longitudinal axis into a crosshead die mounted on a plastic extrusion machine, the same extruding a thermoplastic resin onto the wood, forming a protective coating thereon as the wood passes through the crosshead die. In general, the rails or fence posts, depending upon the size of the die being used, are passed therethrough end to end at a rate slightly faster than the rate of extrusion so that the extruded coating is somewhat pulled longitudinally while still being warm. This in turn causes the extruded coating to want to decrease in transverse dimension. If the wood members being coated have sharp corners thereon, this puts considerable tension on the coating, tending to draw the same tightly against the sharp corners, resulting in the plastic coating drawing thin thereover or even splitting the coating along the edge.

This problem can be avoided by the removal of the material constituting the sharp edge either by hand, or by an appropriate powered cutting tool. Hand removal is suitable for test purposes, though it is way too slow and inefficient for production purposes. Hand removal using an appropriate power tool is much better, though still is much more time consuming and expensive than desired.

Since the wood members are feed end to end through the crosshead die, one can readily feed the members end to end through an appropriate powered cutting machine prior to the crosshead die, to automatically remove the corners just before the members proceed into the crosshead die for coating. Because the rails as well as the posts are well controlled in cross-sectional dimensions so that the respective crosshead die of fixed dimensions will provide a substantially uniform coating on all rails or posts, such a cutting machine, in theory, can readily provide the desired result. In practice however, the wood members, particularly the rails, frequently have some twist end to end. Thus, accurately aligning and guiding the wood members through the cutters from a location other than the longitudinal position of the cutters can result in some skew of the cross-section of the wood member at the cutters, resulting in an excessive cut on one or more corners and an inadequate cut on other corners, the extent of which may vary along the length of the wood member. In that regard, while neither posts nor rails having any substantial bend or curve therein may be used and still achieve the ultimate desired aesthetic appearance, particularly the rails may have substantial twist from end to end and still be useable, as any such twist will be taken out when the ends of the rail are fastened between two parallel posts on installation.

Inadequate removal of the sharp corner, of course, will leave a sufficient corner to still cause thinning of the plastic coating at the corner region. Excessive breaking of the corner, on the other hand, will result in the plastic coating being particularly thick in the corner regions. This too is undesireable, as the thicker region will not stretch as much as the thinner sections in response to the lateral tension which develops prior to and as the freshly applied coating cools. Also, the thicker plastic will tend to hold the heat, making the coating immediately adjacent thereto slower to cool and thus more prone to stretching in response to the lateral tension. The net result can be an irregularity in thickness in the coating in that region, giving a perceivable streak or depression in the coating surface in that region.

The ideal coating is a coating of uniform thickness over a wood member of relatively closely controlled dimensions and with rounded corners. It is to this end that the crosshead die is proportioned and that the plastic extrusion rate and feed rate of the wood therethrough is predetermined. Accordingly, a sharp corner on the wood will result in a very thin, if any, coating thereover at the time of extrusion, even before the lateral tension causes further thinning and/or separation of the coating at the corner. Excessive removal of a corner, on the other hand, may result in inadequate filling of the corner region, or even with adequate filling, may result in a waviness in the surface of the junction of the thick and thinner sections after cooling.

BRIEF SUMMARY OF THE INVENTION

A method and apparatus for breaking corners of wood members prior to the plastic coating of the same is disclosed. In accordance with the method, the wood members such as fence rails and posts are forced between a system comprising four spring mounted rollers, each of which forcibly engages one corner of the wood member and crushes the same in the desired profile. The rollers may be shaped to provide a radius type profile or other desired profile, or alternatively, may be substantially flat to break the 90 degree corner into two more gentle 45 degree corners. In general, the amount of the crushing is controlled by the spring pressure forcing the rollers into the corners, and is relatively self controlling because of the increase in the width of the crushed area as the amount of crushing increases. Such crushing removes the sharp corner on the rails and posts so that upon the subsequent plastic extrusion coating process, the tendency of the plastic coating to contract laterally will not cause the plastic coating to unnecessarily thin at the corners of the wood members, or to be out thereby.

BRIEF DESCRIPTION OF THE DRAWINGS

FIG. 4 is a view taken along line 4—4 of FIG. 3.

FIG. 5 is a view of the crushing system taken along line 5—5 of FIG. 4.

FIG. 6 is a cross-section of a plastic coated post having the corners thereof crushed at a 45 degree angle.

FIGS. 7, 8 and 9 illustrate various alternative crushing roller configurations for use in the crushing system of the present invention.

DETAILED DESCRIPTION OF THE INVENTION

Figure 1:
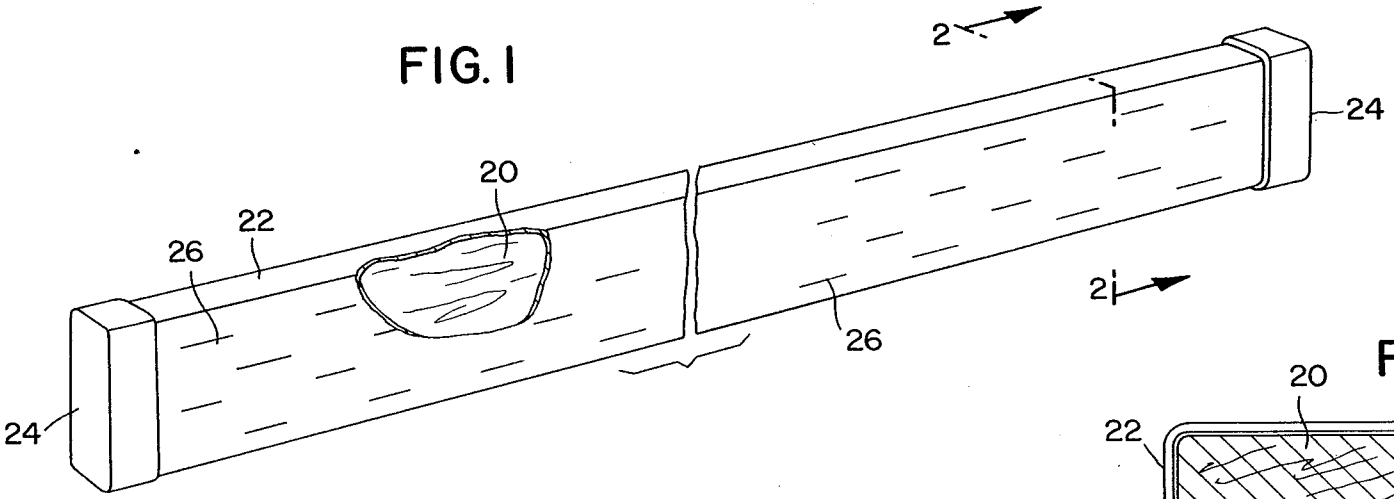
FIG. 1 is a perspective view of a plastic coated wooden rail generally in accordance with U.S. Pat. No. 4,181,764 but with the corners of the rail rounded in accordance with the method and through the use of the apparatus of the present invention.

First referring to FIG. 1, a perspective view of a coated rail in accordance with U.S. Pat. No. 4,181,764 may be seen. The rail is comprised of a wood member 20 coated with a plastic coating 22 and having end caps 24 thereon to protect the ends of the wood member 20. In accordance with the foregoing patent, the coated member may also include slits, pin pricks or the like to provide a plurality of one way valves to relieve pressure from the inside and prevent blistering, yet generally prevent at least water in the liquid phase from penetrating the same.

Figure 2:
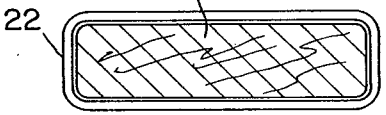
FIG. 2. is a cross-section of the rail of FIG. 1 taken along line 2—2 thereof.

Now referring to FIG. 2, a cross-section of the rail of FIG. 1 may be seen. As shown therein, the wood member 20 has the corners thereof rounded, with the coating 22 thereon similarly being rounded so that the same has a uniform thickness throughout. Thus any lateral tension in the coating which is developed prior to and a the plastic cools after application will result in substantially equally distributed stretching throughout the coating without any thinning thereof. FIG. 6 on the other hand, shows a similar cross-section for a post. Here the wood member 28 is shown with square corners being left thereon. The coating 22*a* is shown with the corners being thinned essentially to extinction. Such thinning may be initially caused by the crosshead die which does not have square corners thereon, but will occur in any event from the lateral tension in the coating as a result of the sharp corners essentially piercing or cutting the still relatively soft coating thereon.

Figure 3:
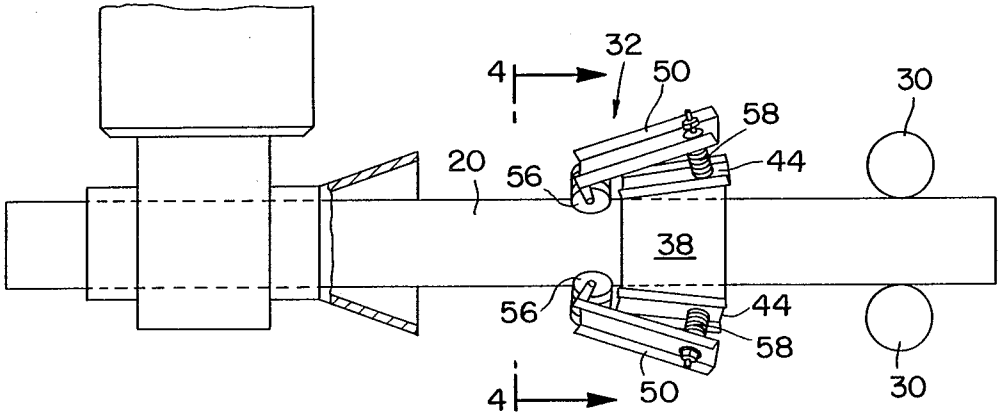
FIG. 3 is a schematic illustration of the plastic coating system for applying to plastic coating to rails and posts such as that illustrated in FIG. 1 showing the present invention crushing system as a part thereof.

Now referring to FIG. 3, a setup for plastic coating the wood members incorporating the present invention may be seen. As in U.S. Pat. No. 4,181,764, a crosshead die 28 is coupled to an extruder, not shown, to extrude a plastic coating onto the wood member 20 as the same is feed through the extruder by rollers 30, one or both of which are driven by an appropriate gear motor. The wood members are driven end to end through the extrusion head in a substantially continuous process, and with the coating being continuous between successive wood members. The abutting ends of two adjacent wood members are visually apparent, however, when the same exits the crosshead die, with the wood members being readily separable before the extruded plastic is cooled by water through the use of a sharp knife, all of course prior to trimming and finishing of the ends thereof.

In accordance with the present invention, a system of spring loaded rollers, generally indicated by the numeral 32, is positioned between the drive rollers 30 and the crosshead die 28, which as shall subsequently be seen, rides on the corners of the wood members being fed therethrough and crushes the same to break the sharp corners thereon, as if material in fact had been removed. Details of the system of spring mounted rollers 32 may be seen not only in FIG. 3, but also in FIGS. 4 and 5. The basic structure for the device is provided by a rectangular funnel-like structure, formed by welding together along the edges thereof four trapezoidal shaped steel plate members 34, 36, 38 and 40 (See FIG. 4) supported with the larger end thereof facing the rollers 30 to receive and accurately center the end of a board 20 for coating as a rail as the board proceeds down the funnel-like structure and out the smaller end thereof. A similar funnel-like structure, generally indicated by the numeral 42 is mounted on or adjacent the crosshead die to similarly align the boards just prior to entry into the crosshead die itself. Such structures allow the next board to be fed through rollers 30 (FIG. 3) end to end with the previous board to push the same through the roller assembly and through the crosshead die with any misalignments therebetween being corrected by the hereinbefore described funnel-like structures.

As may be best seen in FIG. 5, welded to each of the corners of the funnel-like assembly at a 45 degree angle thereto is a member 44. Supported adjacent the smaller end of the funnel-like member is a first hinge member 46, and adjacent the large end of the funnel-like structure is a threaded rod 48. Adjacent each of members 44 is a channel member 50 having a hinge member 52 thereon cooperating with hinge member 46 so as to be rotably supported thereby on hinge pin 54. One end of each of members 50 supports a roller 56 for engaging a respective corner of board 20 for crushing the same. At the opposite end of each of members 50 is a compression spring 58 acting in compression between washer 60 and compression adjustment nut 62, and the respective end of member 50 Thus, by adjustment of nut 62, one can control the force between roller 56 and the corner of the board 20. To limit the inward motion of the roller 56, threaded rod 48 protrudes through a hole in the end of member 50, with lock nut 64 being adjustable to adjust the limit of travel of the adjacent end of member 50 when there is not any board between the rollers for any reason.

In the embodiment specifically shown in FIGS. 3, 4 and 5, the rollers 56 are grooved with a generally circular arc groove 66, shown also in FIG. 8, which is a view of a typical roller 56 detached from the rest of the assembly. Such a contour provides an additional self centering characteristic for the boards as they proceed through the roller assembly, as well as nicely rounding the otherwise sharp corners of the boards to provide the rounded corners illustrated in FIG. 2. Also, the rollers, whether contoured as illustrated in FIGS. 4 and 8, cylindrical as in the roller 56*a* of FIG. 9, or gently curved as illustrated by the roller 56*b* of FIG. 10, the crushing provided thereby tends to be self regulating due to the fact that the area of contact of the roller steadily increases as the depth of crushing increases, stopping when the force between the roller and the board is distributed over such an area that the pressure drops below that required for further crushing. On the other hand, the spring support of the rollers allows the same to ride over a particularly hard spot on the board if necessary, and to follow slightly larger or smaller boards to provide adequate crushing without excessive or inadequate crushing resulting. In that regard, while fixedly mounted rollers could be used, the spring mounted rollers are preferred, as fixed rollers would provide an amount of crushing inversely related to the exact size of the board, and would not have the ability to ride over particularly hard spots without excessive crushing on the opposite corner.

Now referring to FIG. 6, a cross section of a coated post with the corners crushed flat, rather than curved as by a roller 56*a* of FIG. 8, may be seen. As shown, the plastic coating is made to have a uniform thickness thereover, and accordingly similarly has the corners broken, though radiused corners or the like may also readily be used. While the flat crushing illustrated in this figure, at least in theory, exchanges one 90 degree corner for two 45 degree corners, this reduction is generally adequate to sufficiently break the sharp corner to avoid the problems hereinbefore described with respect to a sharp 90 degree corner. Accordingly a radiused, flattened or otherwise contoured corner generated by appropriate rollers in the corner crushing system of the present invention will in general achieve the desired result, though the radiused rollers as illustrated in FIG. 7 are preferred as providing a more desirable shape of the corners, and at the same time having the capability of accurately aligning the board at the position of the rollers rather than possibly trying to twist the same against the restraint of the tapered funnel-like section.

Thus, while certain preferred embodiments of the present invention have been disclosed and described in detail herein, it will be obvious to those skilled in the art that various changes in form and detail may be made in the invention without departing from the spirit and scope thereof.

I claim:

1. Apparatus for breaking the sharp corners on wooden fence posts and rails prior to coating the same comprising;

alignment means for aligning a local cross section of a wood member as it is being passed therethrough;

a plurality of rollers adjacent to said alignment means and supported with respect thereto, each of said rollers being moveable between positions of greatest and least separation and disposed so as to be engageable with a corner of a wood member forced through said alignment means when in a position between the greatest and least separation; and, spring means for encouraging said rollers to positions of least separation whereby said spring means will force said rollers against the corners of a wood member forced through said alignment means to crush the same.

2. The apparatus of claim 1 wherein said rollers are cylindrical.

3. The apparatus of claim 1 wherein said rollers are concave rollers.

4. The apparatus of claim 1 whrein the axis of each roller is substantially perpendicular to a line which will bisect the angle of the two adjacent surfaces of the wood member defining the corner thereof to be broken.

5. The apparatus of claim 1 wherein said spring means is adjustable.

* * * * *

UNITED STATES PATENT AND TRADEMARK OFFICE

CERTIFICATE OF CORRECTION

PATENT NO. : 4,936,359

DATED : 6/26/90

INVENTOR(S) : Totten

It is certified that error appears in the above-identified patent and that said Letters Patent is hereby corrected as shown below:

| | | |
|---|---|---|
| col. 02, line 50 | delete "out" | insert --cut-- |
| col. 03, line 23 | delete "a" | insert --as-- |

Signed and Sealed this

Twentieth Day of April, 1993

*Attest:*

MICHAEL K. KIRK

*Attesting Officer*

*Acting Commissioner of Patents and Trademarks*